US007766249B2

(12) United States Patent
Osler

(10) Patent No.: US 7,766,249 B2
(45) Date of Patent: Aug. 3, 2010

(54) ANCHOR-BOLT ASSEMBLY

(76) Inventor: Wilbur F. Osler, 13355 Main Rd., Mattituck, NY (US) 11952

( * ) Notice: Subject to any disclaimer, the term of this patent is extended or adjusted under 35 U.S.C. 154(b) by 386 days.

(21) Appl. No.: 11/789,518

(22) Filed: Apr. 25, 2007

(65) Prior Publication Data

US 2008/0265050 A1 Oct. 30, 2008

(51) Int. Cl.
*E01B 13/00* (2006.01)
*E01B 21/04* (2006.01)

(52) U.S. Cl. ..... 238/317; 238/377

(58) Field of Classification Search ..... 238/310, 238/315, 316, 317, 377

See application file for complete search history.

(56) References Cited

U.S. PATENT DOCUMENTS 4,494,695 A * 1/1985 Sonneville ..... 238/265

* cited by examiner

*Primary Examiner*—S. Joseph Morano
*Assistant Examiner*—Robert J McCarry, Jr.
(74) *Attorney, Agent, or Firm*—Andrew Wilford

(57) ABSTRACT

A rail-carrying plate lies on an upper surface of a base. An anchor-bolt assembly has an elastomeric buffer sheet between the rail plate and the base upper surface and a bolt set in the anchor sleeve passing through the rail plate. An inner ring surrounds the bolt, bears directly on the base surface, is pressed downward by the bolt against the base surface, has an annular outwardly directed outer surface. An outer ring is transfixed by the bolt, has an annular inner surface spaced outward from the inner-ring outer surface, and bears upward on the rail plate. An annular elastomeric body between the inner and outer rings is bonded to the respective outer and inner surfaces thereof so that vertical displacement of the outer ring relative to the inner ring tends to self-center the two rings.

11 Claims, 3 Drawing Sheets

ANCHOR-BOLT ASSEMBLY

FIELD OF THE INVENTION

The present invention relates to an anchor-bolt assembly. More particularly this invention concerns an assembly comprised of a metal plate on which one or more rails is fixed, a metal or plastic sheet laminated to an elastomeric pad that fits between the plate and an underlying support surface, and a resilient anchor bolt that passes through the plate, sheet, and pad and secures the plate down to the support surface.

BACKGROUND OF THE INVENTION

In numerous rail-transport applications it is standard to secure a running rail to a steel plate that in turn is secured to a concrete sleeper, base, slab or other rigid support surface. The structure must be extremely strong, yet at the same time must have the ability to yield somewhat both vertically and horizontally.

The structure must also permit some limited downward and horizontal movement of the rail plate as the train passes over it. It does not normally need to accommodate upward movement. The downward movement that is permitted, however, must be resisted with a force that prevents the plate from bottoming or over deflecting, yet that still allows some movement to accommodate the passing train.

OBJECTS OF THE INVENTION

It is therefore an object of the present invention to provide an improved anchor-bolt assembly with buffer sheet.

Another object is the provision of such an improved anchor-bolt assembly that satisfies the above-given requirements, in particular that provides the necessary elastic response to the particular conditions.

SUMMARY OF THE INVENTION

An anchor sleeve defining an axis is imbedded in a base, and a rail-carrying plate lies on an upper surface of the base. A resilient anchor-bolt assembly has according to the invention an elastomeric buffer sheet or belt at the sleeve between the rail plate and the base upper surface and a bolt set in the anchor sleeve and passing axially through the rail plate. An inner ring surrounds the bolt, bears directly on the base surface, is pressed axially downward by the bolt against the base surface, has an annular radially outwardly directed outer surface, and has a lower end spaced axially above the base upper surface. An outer ring is axially transfixed by the bolt, has an annular inner surface spaced radially outward from the inner-ring outer surface, and bears axially upward on the rail plate. An annular elastomeric body between the inner and outer rings is bonded to the respective outer and inner surfaces thereof so that vertical displacement of the outer ring relative to the inner ring is resisted mainly as shear in the elastomeric body. Horizontal displacement is resisted so forcefully as to be insignificant so that track gage is maintained.

With this system, therefore, the rail plate is not simply bolted to the base, e.g. concrete sleeper or support surface, but a separate underlying buffer system is provided primarily to allow controlled vertical displacement of the rail plate. Though not its primary purpose, it also contributes to controlling horizontal shifting. The elastomeric body is primarily stressed vertically so that its vertical response can be very accurately tailored to conditions.

In other words the anchor-bolt assembly provides controlled horizontal displacement with little resistance to vertical movement while the elastomeric pad controls vertical displacement while having a minor function with regard to control of horizontal movement.

The bolt in accordance with the invention has a head and includes a rigid metal washer underneath the head and bearing downward via an insulating washer on the rail plate. In addition the inner and outer surfaces of the outer and inner rings are generally frustoconical and flare axially downward. Such a tapered formation ensures an increasing resistance to horizontal displacement of the outer ring, thus restricting horizontal movement of the rail plate. The tapered formation also gives minimal resistance to vertical displacement that is primarily controlled by the buffer sheet.

The outer ring of the assembly and the rail plate have at the hole complementary interengaging formations that transmit axial force from the rail plate downward to the outer ring and that lock the outer ring to the rail plate. These formations are frustoconical or stepped, with the steps being of increasing size going downward so that the hole in the top of the plate is as small as possible. Thus the inner edge of the hole in the rail plate is stepped complementarily to the outer surface of the outer ring. To limit horizontal forces acting on the anchor bolt only the vertical face of the lowest step transmits lateral force and the upper face each step transmits all of any vertical forces. Thus the steps define a radially outwardly directed annular upper face normally out of direct radial engagement with the plate and a radially outwardly directed annular lower face in permanent radial contact with the plate.

BRIEF DESCRIPTION OF THE DRAWING

The instant invention is more fully detailed in the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1A:
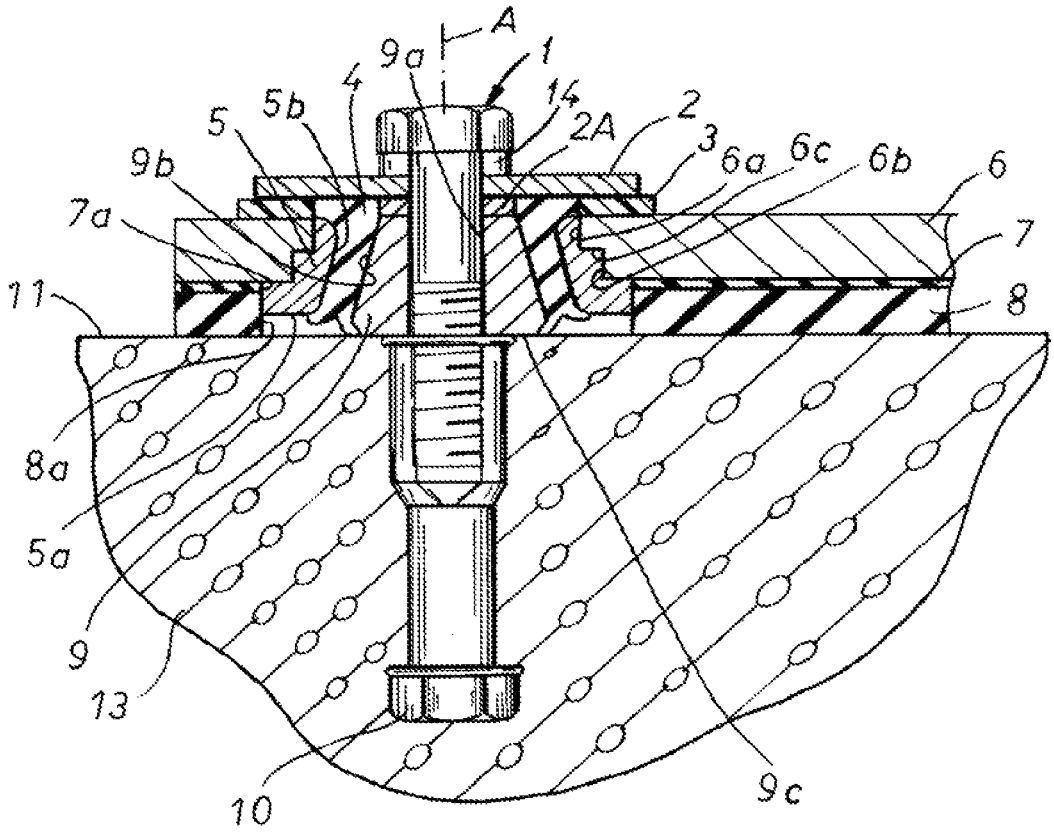
FIG. 1A is a vertical section through a first embodiment of the anchor-bolt assembly according to the invention.
Figure 1B:
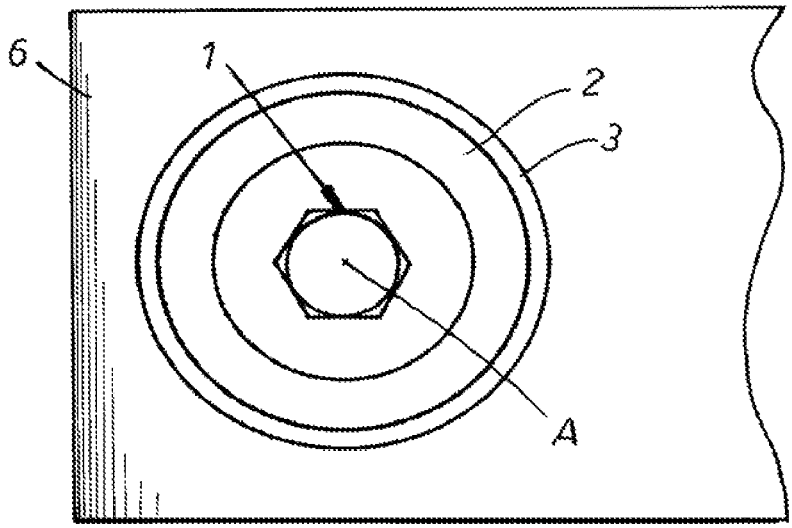
FIG. 1B is a top view of the structure of FIG. 1A.

As seen in FIGS. 1A and 1B, a concrete base 13 has a planar upper face 11, and a nylon or steel anchor sleeve 10 centered on a vertical axis A is imbedded in it. A steel bolt 1, which may be 1 in in diameter, has a threaded shank seated in the sleeve 10 so it extends along the axis A and has a head bearing axially downward via a lock washer 14 on a flat steel washer 2 having a pair of opposite planar faces and inner and outer peripheries. An insulating, e.g. nylon or fiberglass, washer 3 is provided under the rigid steel washer 2.

An unillustrated switch rail is secured to a thick steel plate 6 formed centered on the axis A with a vertically throughgoing hole that is stepped to have an upper portion with an inner surface 6*a* of small diameter centered on the axis A and a lower portion with a larger-diameter inner surface 6*b*, separated by a step or shoulder 6*c*. The surfaces 6*a* and 6*b* are, as shown in dashed lines in FIG. 4 of rectangular shape with rounded corners. The face 6*a* is normally slightly smaller than the corresponding part of the plate 6 while the face 6*b* is a tight fit in the plate 6 so that horizontal forces are transmitted between the plate 6 and the bolt 1 as low as possible, reducing any lever action on the bolt 1.

This plate 6 has a lower face bearing on the upper face of a hard metal or nylon sheet 7 whose lower face is bonded to the upper face of an elastomeric cushion sheet or pad 8 whose thickness is a multiple of the thickness of the nylon sheet 7 but slightly smaller than the thickness of the plate 6. The sheets 7 and 8 are formed with identically shaped holes 7*a* and 8*a* that are centered on the axis A but of larger horizontal dimension radial of the axis A than the portion 6*b*.

Inside the concentric holes of the plate 6 and sheets 7 and 8 a steel inner ring 9 with an overall height slightly less than that of the plate 6 and sheets 7 and 8 snugly surrounds the shaft of the bolt 1 with a cylindrical center bore 9*a*, and has a frustoconical outer surface 9*b* and a flat bottom surface 9*c*, the latter bearing directly on the base surface 11. The washer 2 bears via a small-diameter washer 2A, which could be integral with the ring 9, directly on the upper surface of the inner ring 9 and, through it, on the upper face 11 of the concrete base 13. Thus the bolt, washers 14, 2, and 2A, and ring 9 form a center core subassembly that is essentially nonmovable once the bolt 1 has been torqued into place.

A stepped steel outer ring 5 has three portions respectively fitting in the upper portion 6*a* of the plate 6, the lower portion 6*b* of the plate 6, and the holes 7*a* and 8*a* of the sheets 7 and 8. It has a vertical height less than the overall thickness of the plate 6, and sheets 7 and 8 so that its planar lower face 5*a* is spaced above the surface 11 by a distance equal to about half of the thickness of the sheet 8. This ring 5 has a frustoconical inner surface 5*b* spaced radially outward from and parallel to the surface 9*b* of the ring 9.

An elastomeric buffer ring 4 has an outer surface bonded to the surface 5*b* and an inner surface bonded to the surface 9*b* and an upper portion formed with a flange projecting upward past the upper surface of the rail plate 6. Thus the buffer ring has a compression fit with washer 3 so that it will follow the rail plate 6 when deflected under load. The small steel washer 2A is set in the upper end of this buffer ring 4, although it could be integral with the part 9.

The plate 6 is able to move limitedly vertically downward from its illustrated position and horizontally relative to the bolt 1 and inner ring 9 and this movement can be controlled by varying the stiffness of the various elastomeric parts. Downward movement takes place with compression of the sheet 8 and with limited stressing of the ring 4 in shear. The frustoconical surfaces 9*b* and 5*b* taper upward so that they get closer together as the outer ring 5 moves downward. Due to the distribution of compression and shear forces, there is very little resistance to downward movement but substantial resistance to horizontal movement of the plate 6. The pad 8 assumes most of the vertical load.

As far as lateral shifting of the plate 6, this can take place with limited radial compression of the ring 4 and is very restricted. The bolt 1, however, solidly clamps the inner ring 9 to the base 13 by pressing it forcefully against the face 11 so that such horizontal forces will largely be applied to the ring 9 and its connection to the base 13, with little or none of such horizontal forces acting on the bolt 1. Upward movement of the plate 6 is essentially controlled by the anchor-bolt assembly. Upward forces caused by the rail "wave" formed ahead of a train wheel or by thermal deformation rarely exceeds 2000 to 2500 lbs of force and is easily resisted by the bolt structure.

Figure 2:
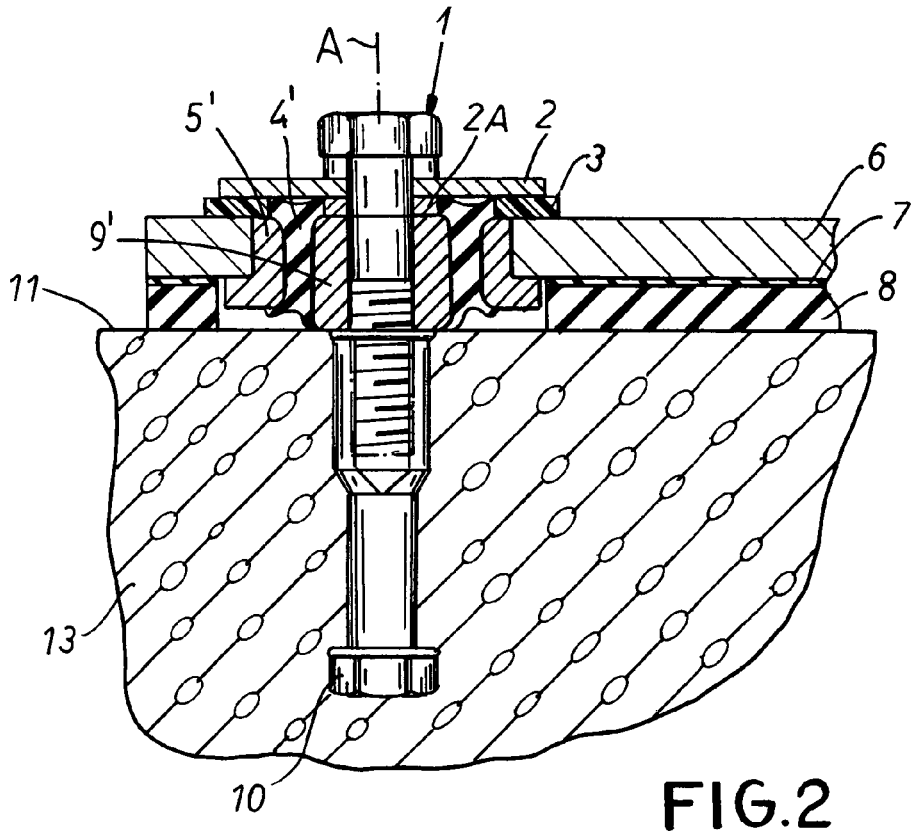
FIGS. 2 and 3 are views like FIG. 1 of second and third embodiments of this invention.

FIG. 2 shows an arrangement where the ring 4' is essentially rounded-rectangular and centered on the axis A. The inner and outer surfaces of the rings 5' and 9' are similarly complementarily shaped.

Figure 3:
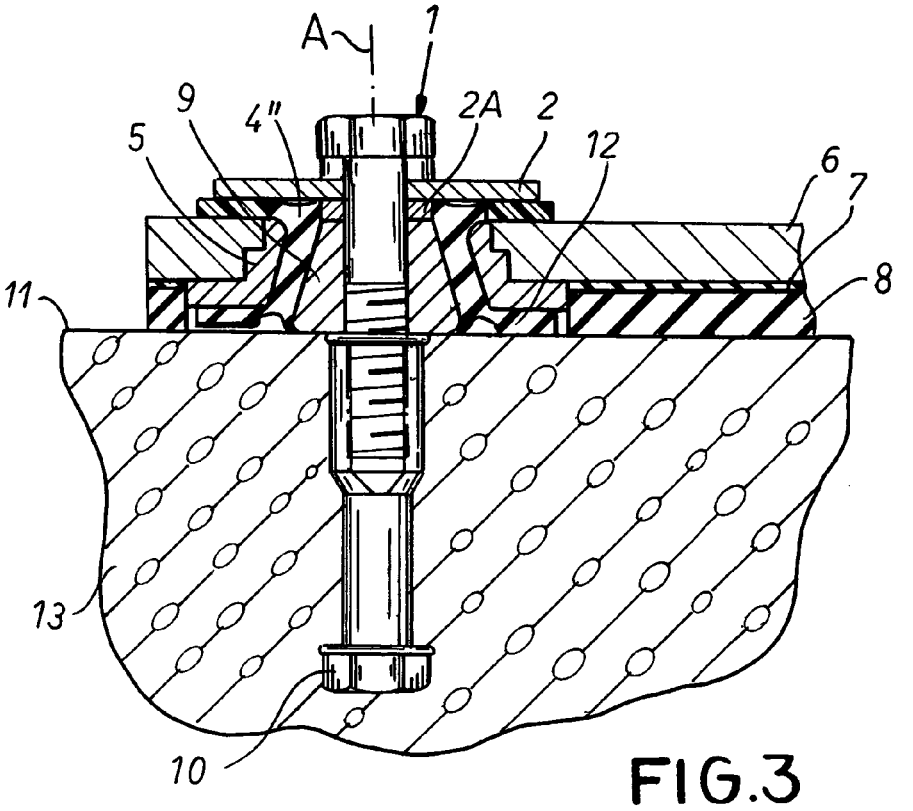

In FIG. 3 the ring 4" is shaped the same as in FIG. 1, but it has at its lower end a radially extending flange 12 that serves as a further buffer/spring between the lower face of the outer ring 5 and the upper surface 11 of the base 13.

Figure 6:
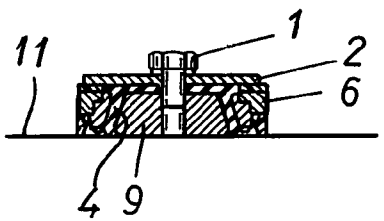
FIGS. 5 and 6 are sections taken along respective lines V-V and VI-VI of FIG. 4.
Figure 5:
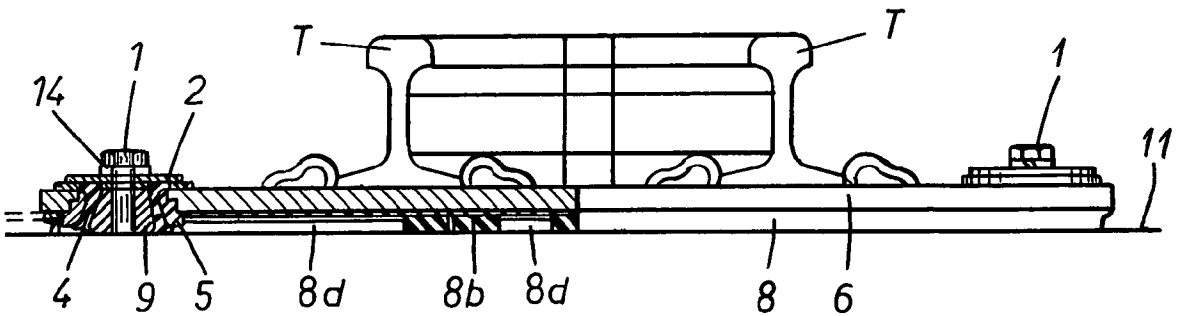
Figure 4:
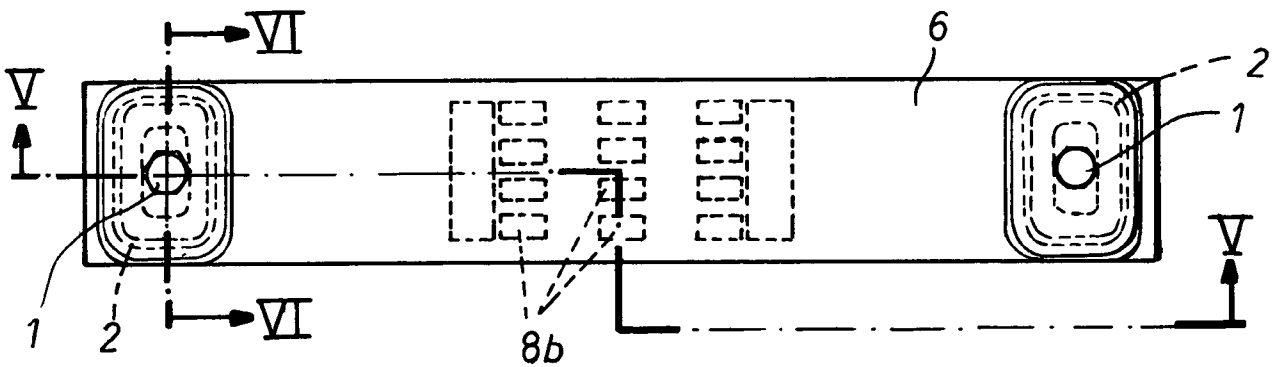
FIG. 4 is a top view of a rail plate with anchor-bolt assemblies with buffer sheet according to the invention.

FIGS. 4-6 show how the steel plate 6 is actually an elongated bar that extends perpendicular to tracks T that are bolted or otherwise fixed to the plate 6. The pad 8 is shown to have open pockets or voids 8*d* in regions offset from the bolts 1. These voids 8*d* largely eliminate resistance to vertical downward shifting of the plate 6, such shifting only being resisted by vertical compression pads 8*b* formed between the voids 8*d*. Their distribution is dependent on the desired deflection needed for the particular assembly. The length of the plate 6 is dependent on where it is installed, being fairly short (e.g. 34 in) when it is relatively close to the point of switch and somewhat longer (e.g. 52 in) when at a frog. The pad 8 therefore allows the track T and attached parts centrally located on the plate 6 to move somewhat downward as a train passes, but the bolts 1 prevent any upward movement of the ends of the plate 6. Thus as a train moves around a corner, the entire plate will, in effect, move downward on the outside of the turn and tend to pivot about the bolt on the inside of the turn.

The system of this invention has numerous advantages the bonded elements 7 and 8 provide controlled vertical displacement caused by passing trains. At the same time they facilitate bonding of the elements 7 and 8 since they have less mass than conventional designs that bond the pad 8 directly to the plate 6, shorter cure time, and lower handling and shipping costs. Thus they are more economical and easier to handle and install. The sheet 7 provides horizontal stability so that the elastomeric pad 8 cannot walk out of alignment under rail plate 6 is as the result of repetitive loading. The sheets 7 and 8 with the resilient anchor-bolt assembly according to the invention can be sent together to the switch manufacturer or to the track contractor who will at the installation site put it under track plates received from the switch manufacturer. Although field replacement is rare, they can also easily be replaced as a single unit in the field, unlike the prior-art systems where an elastomeric plate is bonded to the rail plate.

I claim:

1. In combination with a base in which an anchor sleeve defining an axis is imbedded and a plate lying on an upper surface of the base and on top of which rests a rail, a resilient anchor-bolt assembly comprising:

an elastomeric buffer sheet between the rail plate and the base upper surface;

a bolt set in the anchor sleeve, having a head, and passing axially through the rail plate and bearing downward on the plate;

an insulating washer compressed vertically between the bolt and an upper surface of the rail plate;

a rigid metal washer underneath the head and bearing downward on the insulating washer;

a metallic inner ring surrounding and radially bearing directly on the bolt, having a lower end pressed axially downward by the bolt against the base surface, and having an annular radially outwardly directed outer surface;

a metallic outer ring transfixed by the bolt, having an annular inner surface spaced radially outward from the inner-ring outer surface, having a lower end spaced mainly above the base surface, and bearing axially upward and radially outward on the rail plate; and an annular elastomeric body between the inner and outer rings and bonded to the respective outer and inner surfaces thereof, whereby vertical displacement of the outer ring relative to the inner ring is resisted largely as shear and lateral displacement largely as compression in the elastomeric body.

2. In combination with a base in which an anchor sleeve defining an axis is imbedded and a rail-carrying plate lying on an upper surface of the base, a resilient anchor-bolt assembly comprising:

an elastomeric buffer sheet between the rail plate and the base upper surface;

a bolt set in the anchor sleeve and passing axially through the rail plate and bearing downward on the plate;

an inner ring surrounding the bolt, having a lower end pressed axially downward by the bolt against the base surface, and having an annular radially outwardly directed outer surface;

an outer ring transfixed by the bolt, having an annular inner surface spaced radially outward from the inner-ring outer surface, having a lower end spaced mainly above the base surface, and bearing axially upward and radially outward on the rail plate, the outer ring and the rail plate having at the hole complementary interengaging steps that transmit axial force from the rail plate downward to the outer ring and that permit the outer ring to shift downward relative to the rail plate; and an annular elastomeric body between the inner and outer rings and bonded to the respective outer and inner surfaces thereof, whereby vertical displacement of the outer ring relative to the inner ring is resisted largely as shear and lateral displacement largely as compression in the elastomeric body.

3. The anchor-bolt assembly defined in claim 2 wherein the steps bear upward on lower step faces of the plate.

4. The anchor-bolt assembly defined in claim 2 wherein the steps define a radially outwardly directed annular upper face normally out of direct radial engagement with the plate and a radially outwardly directed annular lower face in permanent radial contact with the plate.

5. In combination with a base in which an anchor sleeve defining an axis is imbedded and a plate lying on an upper surface of the base and on top of which rests a rail, a resilient anchor-bolt assembly comprising:

an elastomeric buffer sheet between the rail plate and the base upper surface;

a hard but flexible sheet bonded to an upper face of the elastomeric buffer sheet and bearing upward on the rail plate;

a bolt set in the anchor sleeve and passing axially through the rail plate and bearing downward on the plate;

a metallic inner ring surrounding and radially bearing directly on the bolt, having a lower end pressed axially downward by the bolt against the base surface, and having an annular radially outwardly directed outer surface;

a metallic inner ring surrounding and radially bearing directly on the bolt, having a lower end pressed axially downward by the bolt against the base surface, and having an annular radially outwardly directed outer surface;

a metallic outer ring transfixed by the bolt, having an annular inner surface spaced radially outward from the inner-ring outer surface, having a lower end spaced mainly above the base surface, and bearing axially upward and radially outward on the rail plate; and an annular elastomeric body between the inner and outer rings and bonded to the respective outer and inner surfaces thereof, whereby vertical displacement of the outer ring relative to the inner ring is resisted largely as shear and lateral displacement largely as compression in the elastomeric body.

6. The anchor-bolt assembly defined in claim 5 wherein the hard but flexible sheet is metallic or plastic.

7. In combination with a base in which an anchor sleeve defining an axis is imbedded and a rail-carrying plate lying on an upper surface of the base, a resilient anchor-bolt assembly comprising:

an elastomeric buffer sheet between the rail plate and the base upper surface;

a bolt set in the anchor sleeve and passing axially through the rail plate and bearing downward on the plate;

an inner ring surrounding the bolt, having a lower end pressed axially downward by the bolt against the base surface, and having an annular radially outwardly directed and downwardly frustoconically flaring outer surface;

an outer ring transfixed by the bolt, having an annular and downwardly frustoconically flaring inner surface spaced radially outward from the inner-ring outer surface, having a lower end spaced mainly above the base surface, and bearing axially upward and radially outward on the rail plate; and an annular elastomeric body between the inner and outer rings and bonded to the respective outer and inner surfaces thereof, whereby vertical displacement of the outer ring relative to the inner ring is resisted largely as shear and lateral displacement largely as compression in the elastomeric body.

8. The anchor-bolt assembly defined in claim 7 wherein the plate is elongated and has a pair of holes at opposite ends each provided with a respective bolt, inner ring, outer ring, and elastomeric body, the elastomeric sheet extending a full length of the plate between the ends thereof.

9. The anchor-bolt assembly defined in claim 7 wherein the rings are of steel.

10. In combination with a base in which two pairs of anchor sleeve defining respective axes is imbedded and an elongated rail-carrying plate lying on an upper surface of the base and having a pair of holes at opposite ends and each positioned over a respective one of the anchor sleeves, a resilient anchor-bolt assembly comprising:

an elastomeric buffer sheet extending a full length of the plate between the rail plate and the base upper surface;

a respective bolt set in each of the anchor sleeves, passing axially through the respective hole of the rail plate, and bearing downward on the plate;

a respective inner ring surrounding each of the bolts, having a lower end pressed axially downward by the respective bolt against the base surface, and having an annular radially outwardly directed and downwardly frustoconically flaring outer surface;

a respective outer ring transfixed by each of the bolts, having an annular and downwardly frustoconically flaring inner surface spaced radially outward from the respective inner-ring outer surface, having a lower end spaced mainly above the base surface, and bearing axially upward and radially outward on the rail plate; and a respective annular elastomeric body between each of the inner and outer rings and bonded to the respective outer and inner surfaces thereof, whereby vertical displacement of the outer rings relative to the inner rings is resisted largely as shear and lateral displacement largely as compression in the elastomeric body.

11. In combination with a base in which an anchor sleeve defining an axis is imbedded and a plate lying on an upper surface of the base and on top of which rests a rail, a resilient anchor-bolt assembly comprising:

an elastomeric buffer sheet between the rail plate and the base upper surface;

a bolt set in the anchor sleeve and passing axially through the rail plate and bearing downward on the plate;

a steel inner ring surrounding and radially bearing directly on the bolt, having a lower end pressed axially downward by the bolt against the base surface, and having an annular radially outwardly directed outer surface;

a steel outer ring transfixed by the bolt, having an annular inner surface spaced radially outward from the inner-ring outer surface, having a lower end spaced mainly above the base surface, and bearing axially upward and radially outward on the rail plate; and an annular elastomeric body between the inner and outer rings and bonded to the respective outer and inner surfaces thereof, whereby vertical displacement of the outer ring relative to the inner ring is resisted largely as shear and lateral displacement largely as compression in the elastomeric body.

* * * * *